US006298747B1

(12) United States Patent
Sutherland et al.

(10) Patent No.: US 6,298,747 B1
(45) Date of Patent: Oct. 9, 2001

(54) CUSHIONED PEDAL

(75) Inventors: Daniel R. Sutherland, East Pointe; Paul A. Bowers, Ray, both of MI (US)

(73) Assignee: TRW Vehicle Safety Systems Inc., Lyndhurst, OH (US)

( * ) Notice: Subject to any disclaimer, the term of this patent is extended or adjusted under 35 U.S.C. 154(b) by 0 days.

(21) Appl. No.: 09/296,058

(22) Filed: Apr. 21, 1999

(51) Int. Cl.[7] ..... G05G 1/14
(52) U.S. Cl. ..... 74/512; 60/533; 92/34
(58) Field of Search ..... 74/512, 513, 560, 74/561, 478.5; 92/91, 92, 89, 90, 34, 45; 60/533, 592

(56) References Cited

U.S. PATENT DOCUMENTS

| | | | | |
|---|---|---|---|---|
| 2,270,900 | * | 1/1942 | Rubissow | 74/513 |
| 2,609,000 | * | 9/1952 | Mowbray | 92/34 |
| 2,808,705 | * | 10/1957 | Ingres | 74/512 |
| 2,966,328 | * | 12/1960 | Burnworth | 74/513 |
| 3,128,859 | * | 4/1964 | Griffen | 74/513 |
| 3,499,368 | * | 3/1970 | Ballantine | 92/34 |
| 3,739,579 | * | 6/1973 | Lutz | 74/512 |
| 4,042,072 | * | 8/1977 | Baba | 92/34 |
| 4,103,371 | * | 8/1978 | Wilson | 60/533 |
| 4,169,353 | * | 10/1979 | Fresard | 92/91 |
| 4,824,340 | * | 4/1989 | Bruggeman et al. | 92/34 |
| 4,894,652 | * | 1/1990 | Eckstein et al. | 74/560 |
| 4,955,658 | * | 9/1990 | Graves | 296/75 |
| 5,435,230 | * | 7/1995 | Phillips | 92/91 |

FOREIGN PATENT DOCUMENTS

| | | | | |
|---|---|---|---|---|
| 2851290 A1 | * | 6/1980 | (DE) | 74/512 |
| 1382696 A | * | 3/1988 | (SU) | 74/512 |

* cited by examiner

*Primary Examiner*—David A. Bucci
*Assistant Examiner*—Chong H. Kim
(74) *Attorney, Agent, or Firm*—Tarolli, Sundheim, Covell, Tummino & Szabo L.L.P.

(57) ABSTRACT

A foot pedal (12, 42) for controlling operation of a vehicle is supported for movement relative to the vehicle. A cushion (22, 60), inflatable by inflation fluid, is connected with and, when inflated, extends from the pedal (12, 42).

20 Claims, 1 Drawing Sheet

BRAKES
10
12
14
18
22
24
25
26
30
40
42
44
46
48
56
58
60
62
72

CUSHIONED PEDAL

FIELD OF THE INVENTION

The present invention relates to a foot pedal for controlling operation of a vehicle, and particularly relates to a cushioned foot pedal for controlling operation of a vehicle.

BACKGROUND OF THE INVENTION

A vehicle, such as an automobile or truck, has pedals which are moved relative to the vehicle by a foot of the vehicle driver to actuate a mechanism, such as the vehicle brakes.

SUMMARY OF THE INVENTION

In accordance with the present invention, an apparatus comprises a foot pedal for controlling vehicle operation. The foot pedal is supported for movement relative to the vehicle by a support. A cushion which is inflatable by inflation fluid is connected with and, when inflated, extends from the pedal.

BRIEF DESCRIPTION OF THE DRAWINGS

The foregoing and other features of the present invention will become apparent to one skilled in the art to which the present invention relates upon reading the following description of the invention with reference to the accompanying drawings, wherein.

DESCRIPTION OF THE PREFERRED EMBODIMENTS

Figures 1, 2, 3, 4, 5:
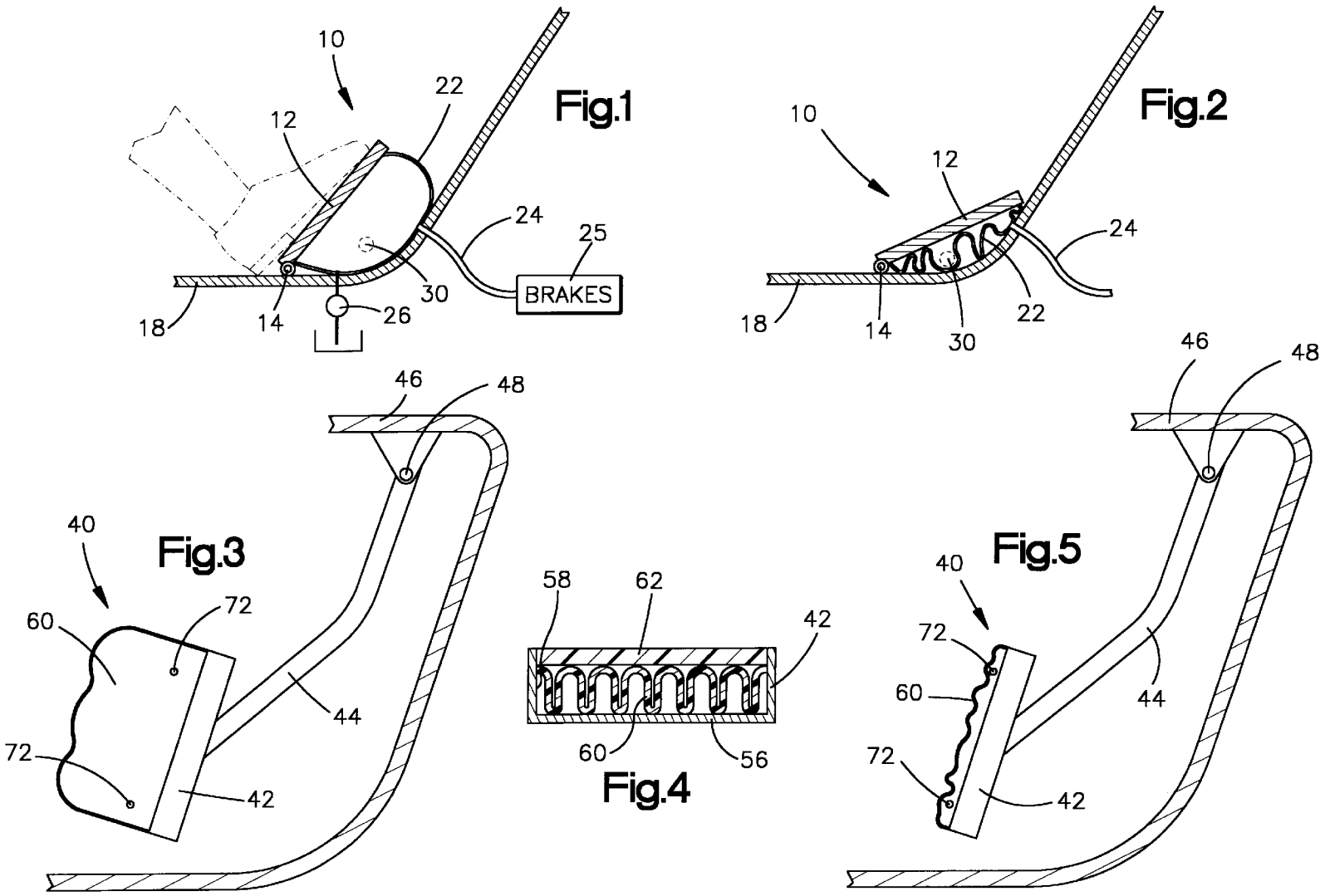
FIG. 1 is a schematic view of a first embodiment of the present invention.
FIG. 2 is a schematic view showing a cushion of FIG. 1 in a deflated condition.
FIG. 3 is a schematic view of a second embodiment of the present invention.
FIG. 4 is a sectional view of a foot pedal of the second embodiment showing a cushion in a stored condition.
FIG. 5 is a schematic view showing the cushion of FIG. 4 in a deflated condition.

An apparatus 10 comprising a first embodiment of the present invention is shown in FIGS. 1 and 2. The apparatus 10 includes a foot pedal 12 engageable by the foot of a driver of a vehicle to control a vehicle operation. A pivot connection 14 pivotally connects the pedal 12 to a vehicle floor 18. Pivotal movement of the pedal 12 relative to the vehicle floor 18 by the foot of a vehicle driver controls a vehicle operation. For example, the pedal 12 may be used to control braking or acceleration of the vehicle.

A cushion 22 (FIG. 1) is connected with the pedal 12 and extends from the pedal 12 to the vehicle floor 18. The cushion 22 is filled with an inflation fluid, such as a gas, liquid, or gel. The cushion 22 has an inflated condition, shown in FIG. 1, and a deflated condition, shown in FIG. 2. A pump 26 pumps fluid from a reservoir to inflate the cushion 22 initially. However, the cushion 22 can be inflated by any suitable mechanism.

A conduit 24 extends from the cushion 22 and communicates with a mechanism 25, such as the vehicle brakes, for controlling operation of the vehicle. The cushion 22 has an internal pressure which varies in response to pivotal movement of the pedal 12 relative to the vehicle floor 18. Operation of the vehicle is controlled in response to the variations in the internal pressure in the cushion 22.

Upon the application of a force to the pedal 12 to pivot the pedal in a clockwise direction, as viewed in FIG. 1, relative to the vehicle floor 18, the pressure in the cushion 22 increases. Fluid flows through the conduit 24 to the mechanism 25 to cause the vehicle brakes to be applied, for example. Upon release of the force, fluid will flow from the mechanism 25 through conduit 24 back into the cushion 22. The pump 26 may be operated to pump fluid from the reservoir to the cushion 22 in the event of fluid leakage from the mechanism 25.

The cushion 22 includes a vent 30 (FIG. 1), which is normally closed. The vent 30 may be formed by a weakened portion in the cushion 22. The vent 30 opens upon application of a force to the cushion 22 above a predetermined force, such as may occur if the vehicle is involved in an accident.

Upon application of a force to the cushion 22 above the predetermined force, the vent 30 opens. For example, the vent 30 opens if the occupant contacts the pedal 12 and/or the cushion 22 and applies a force to the cushion above the predetermined force. When the vent 30 opens, inflation fluid in the cushion 22 is released. The cushion 22 deflates from the inflated condition, shown in FIG. 1, to the deflated condition, shown in FIG. 2. As the inflation fluid flows out of the cushion 22, energy is absorbed to help reduce injury to the driver of the vehicle due to contact with the pedal 12 and/or the cushion 22.

An apparatus 40 comprising a second embodiment of the present invention is shown in FIGS. 3–5. The apparatus 40 includes a foot pedal 42 for controlling vehicle operation. The pedal 42 has an arm 44 pivotally mounted to a support 46 in the vehicle by a pivot bracket 48. Pivotal movement of the pedal 42 relative to the support 46 controls vehicle operation. For example, the pedal 42 may be used to control braking or acceleration of the vehicle.

The pedal 42 (FIG. 4) includes a support member 56 with a recess 58. A cushion 60 is connected to support member 56 by any suitable means and has a stored condition in which the cushion is folded within the recess 58. A removable cover 62 closes the recess 58 to retain the cushion 60 in the stored condition in the recess.

The cushion 60 has an inflated condition (FIG. 3) in which the cushion extends from the pedal 42 in a direction toward the driver of the vehicle. The foot of the driver of the vehicle engages the cushion 60 to move the pedal 42 to control a vehicle operation.

The cushion 60 is inflatable from the stored condition to the inflated condition by a source of inflation fluid (not shown). The inflation fluid may be a gas, liquid, or gel. The source of inflation fluid may be activated by the driver to inflate the cushion 60 after the cover 62 is removed from the support member 56. The source of inflation fluid may be mounted within the vehicle or the pedal 42, or the source of inflation fluid may be a hand-held can of compressed inflation fluid that the driver manually actuates to inflate the cushion 60.

The driver inflates the cushion 60 a sufficient amount so that the cushion extends from the pedal 42 to a position in which the driver can reach the cushion to control vehicle operation. The driver controls how much the cushion 60 is inflated. Accordingly, a driver who is short in stature would inflate the cushion 60 more than a taller driver would.

The cushion 60 includes vents 72 (FIG. 3), which are normally closed. The vents 72 may be formed by weakened portions in the cushion 60. The vents 72 open upon application of a force to the cushion 60 above a predetermined force, such as may occur if the vehicle is involved in an accident.

Upon application of a force to the cushion 60 above the predetermined force, the vents 72 open. When the vents 72 open, inflation fluid in the cushion 60 is released. The cushion 60 deflates from the inflated condition to a deflated condition, shown in FIG. 5. As inflation fluid flows out of the cushion 60, energy is absorbed to help reduce injury to the driver of the vehicle in the situation where the driver applies the force above the predetermined force to the cushion 60.

From the above description of the invention, those skilled in the art will perceive improvements, changes and modifications. Such improvements, changes and modifications within the skill of the art are intended to be covered by the appended claims.

Having described the invention, the following is claimed:

1. Apparatus for helping to protect an occupant of a vehicle, said apparatus comprising:

a pedal for controlling operation of the vehicle;

a support for supporting said pedal for movement relative to the vehicle;

a cushion extending from said pedal, said cushion having an inflated condition for controlling the operation of the vehicle and a deflated condition to which said cushion is actuated from said inflated condition by inflation fluid flowing out of said cushion; and a source of inflation fluid for directing inflation fluid into said cushion to inflate said cushion, said inflation fluid being contained by said cushion at a predetermined pressure when said cushion is in said inflated condition, said cushion absorbing energy from the occupant, during a collision to the vehicle, as the occupant applies a force to the cushion and as said cushion deflates from said inflated condition to said deflated condition thereby reducing injury to the occupant due to contact with said pedal during the collision, said cushion further including a vent that releases inflation fluid upon application of a force to said cushion above a predetermined force, said vent including a weakened portion of said cushion, said weakened portion bursting upon application of a force to said cushion above said predetermined force.

2. Apparatus as defined in claim 1 wherein said inflation fluid is contained in a closed system in said inflated condition and said inflation fluid has been released from an open system in said deflated condition.

3. Apparatus as defined in claim 1 wherein said cushion is adapted to extend from said pedal to a floor of the vehicle.

4. Apparatus as defined in claim 3 wherein said support includes means for pivotally mounting said pedal to the floor of the vehicle.

5. Apparatus as defined in claim 1 wherein said cushion has an internal pressure which varies in response to movement of said pedal relative to the vehicle by the foot of the driver, a vehicle operation being controlled in response to variations of the internal pressure in said cushion.

6. Apparatus as defined in claim 5 further including means for controlling brakes of the vehicle in response to variations of the internal pressure in said cushion.

7. Apparatus as defined in claim 1 wherein said inflation fluid controls the operation of the vehicle by said inflation fluid flowing out of said cushion to a mechanism when said cushion is in said inflated condition.

8. Apparatus as defined in claim 1 wherein said predetermined pressure is greater than atmospheric pressure.

9. Apparatus as defined in claim 1 wherein said cushion does not automatically inflate from said deflated condition subsequent to said force by the occupant being removed from said cushion.

10. Apparatus for helping to protect an occupant of a vehicle, said apparatus comprising:

a pedal for controlling operation of the vehicle;

a support for supporting said pedal for movement relative to the vehicle;

a cushion extending from said pedal, said cushion having an inflated condition for controlling the operation of the vehicle and a deflated condition to which said cushion is actuated from said inflated condition by inflation fluid flowing out of said cushion; and a source of inflation fluid for directing inflation fluid into said cushion to inflate said cushion, said cushion absorbing energy from the occupant as the occupant applies a force to the cushion and as said cushion deflates from said inflated condition to said deflated condition, said cushion further including a vent that releases inflation fluid upon application of a force to said cushion above a predetermined force, said vent including a weakened portion of said cushion, said weakened portion bursting upon application of a force to said cushion above said predetermined force.

11. Apparatus for helping to protect an occupant of a vehicle, said apparatus comprising:

a pedal for controlling operation of the vehicle;

a support for supporting said pedal for movement relative to the vehicle;

a cushion extending from said pedal, said cushion having an inflated condition for controlling the operation of the vehicle and a deflated condition to which said cushion is actuated from said inflated condition by inflation fluid flowing out of said cushion; and a source of inflation fluid for directing inflation fluid into said cushion to inflate said cushion, said cushion absorbing energy from the occupant, as the occupant applies a force to the cushion and as said cushion deflates from said inflated condition to said deflated condition, said cushion not automatically inflating from said deflated condition subsequent to said force by the occupant being removed from said cushion.

12. Apparatus as defined in claim 1 wherein said cushion extends from said pedal toward a driver of the vehicle, said cushion being engageable by the foot of the driver of the vehicle.

13. Apparatus as defined in claim 12 wherein said pedal includes a support portion having a cavity, said cushion being located in said cavity when in a stored condition.

14. Apparatus as defined in claim 13 wherein said pedal includes a cover which covers said cushion when in said stored condition.

15. Apparatus as defined in claim 10 wherein said cushion extends from said pedal toward a driver of the vehicle, said cushion being engageable by the foot of the driver of the vehicle.

16. Apparatus as defined in claim 15 wherein said pedal includes a support portion having a cavity, said cushion being located in said cavity when in a stored condition.

17. Apparatus as defined in claim 16 wherein said pedal includes a cover which covers said cushion when in said stored condition.

18. Apparatus as defined in claim 11 wherein said cushion extends from said pedal toward a driver of the vehicle, said cushion being engageable by the foot of the driver of the vehicle.

19. Apparatus as defined in claim 18 wherein said pedal includes a support portion having a cavity, said cushion being located in said cavity when in a stored condition.

20. Apparatus as defined in claim 19 wherein said pedal includes a cover which covers said cushion when in said stored condition.

* * * * *